United States Patent [19]

Hori et al.

[11] 3,949,721

[45] Apr. 13, 1976

[54] DISTRIBUTOR FOR AN INTERNAL COMBUSTION ENGINE CONTAINING AN APPARATUS FOR SUPPRESSING NOISE

[75] Inventors: Osamu Hori; Teruo Yamanaka, both of Toyota, Japan

[73] Assignee: Toyota Jidosha Kogyo Kabushiki Kaisha, Toyota, Japan

[22] Filed: May 17, 1974

[21] Appl. No.: 470,974

[30] Foreign Application Priority Data

Dec. 28, 1973 Japan ..... 49-3467

[52] U.S. Cl. ..... 123/146.5 A; 200/19 R

[51] Int. Cl.[2] ..... H01H 19/00

[58] Field of Search ..... 200/19 A, 19 DC, 19 DR, 200/19 R; 123/146.5

[56] References Cited

UNITED STATES PATENTS

| | | | |
|---|---|---|---|
| 1,931,625 | 10/1933 | Schwarze | 200/19 DC |
| 1,997,460 | 4/1935 | Fitzsimmons | 200/19 DR |
| 3,248,604 | 4/1966 | Richards | 200/19 R |
| 3,501,600 | 3/1970 | Saulmon | 200/19 A |
| 3,542,006 | 11/1970 | Dusenberry et al. | 200/19 R |

*Primary Examiner*—Charles J. Myhre
*Assistant Examiner*—Joseph Cangelosi
*Attorney, Agent, or Firm*—Kenyon & Kenyon

[57] ABSTRACT

A distributor containing an apparatus for suppressing noise is described, comprising a first discharging gap which exists between electrodes of a distributor rotor and a stationary terminal, both of which are located in the distributor and a second discharging gap to which a resistance element is connected in series, wherein the second discharging gap and the resistance element are connected close to and also, electrically parallel to the first discharging gap.

13 Claims, 26 Drawing Figures

CONVENTIONAL IGNITION CIRCUIT

Fig. 3-a
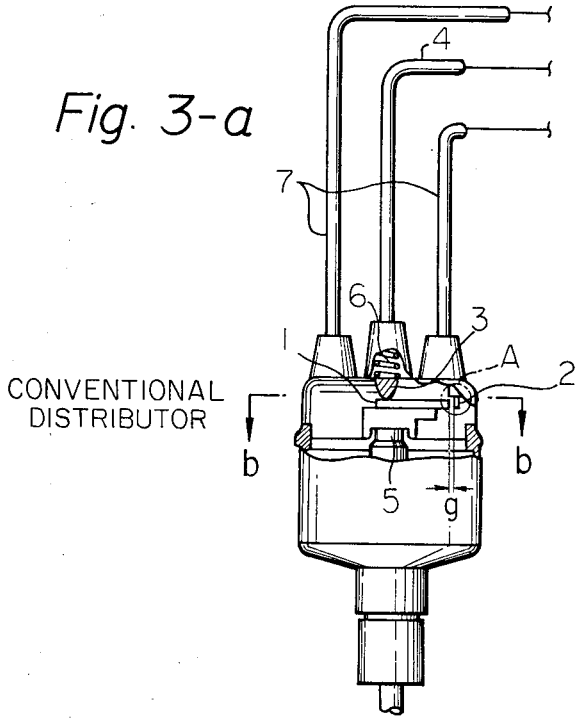
Fig. 3-b
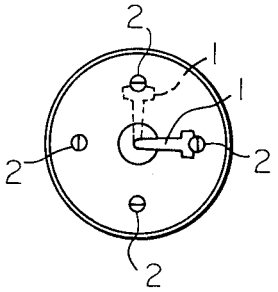

Fig. 4-b
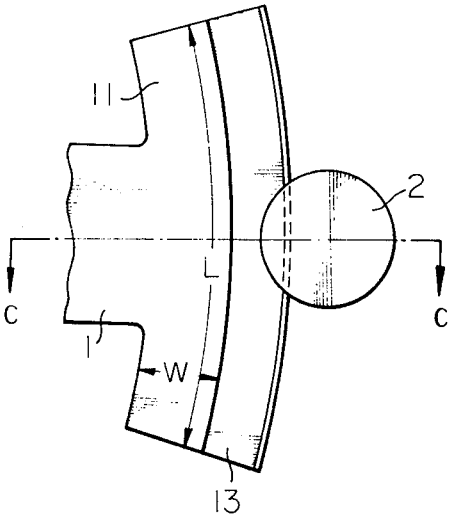
Fig. 4-a
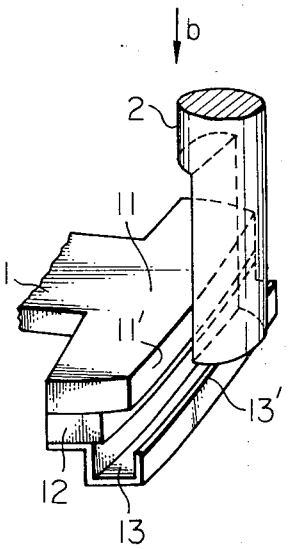
Fig. 4-c
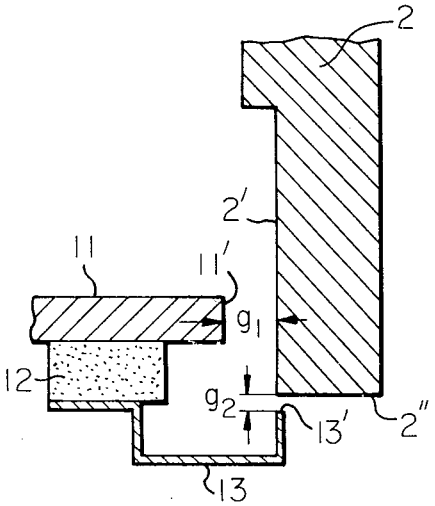

Fig. 7-a
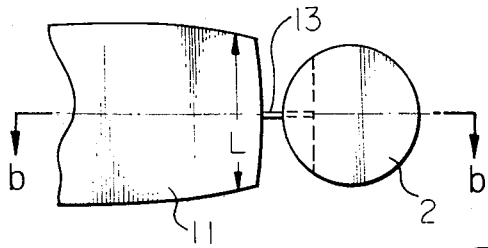
F
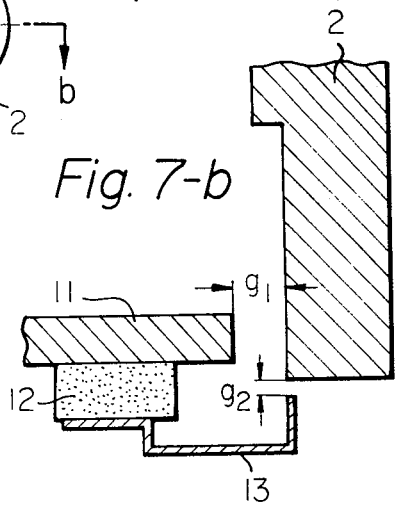
Fig. 7-b
Fig. 8-a
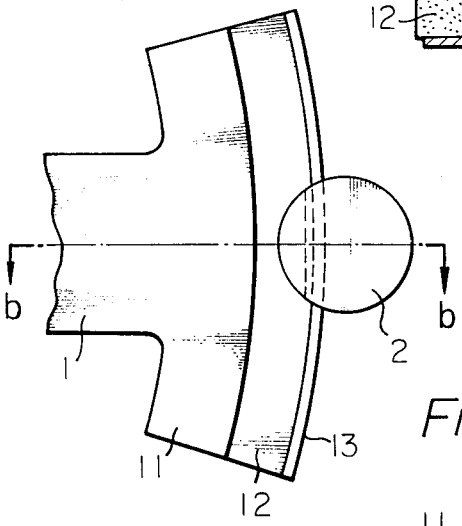
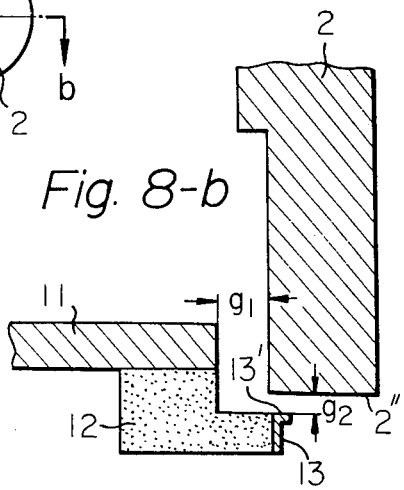
Fig. 8-b Fig. 9-a
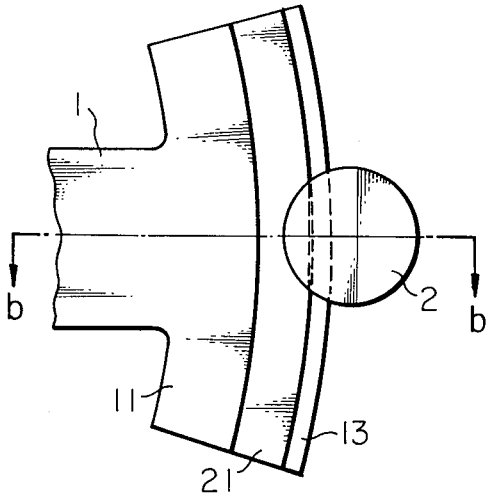
Fig. 9-c
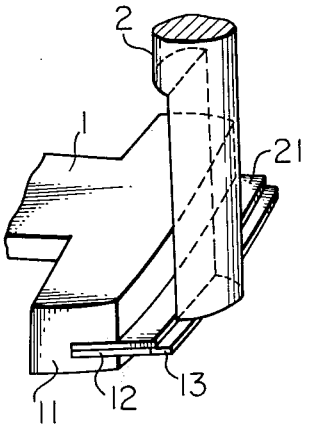
Fig. 9-b
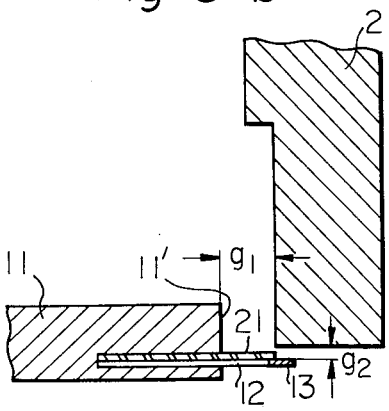

Fig. 10-a
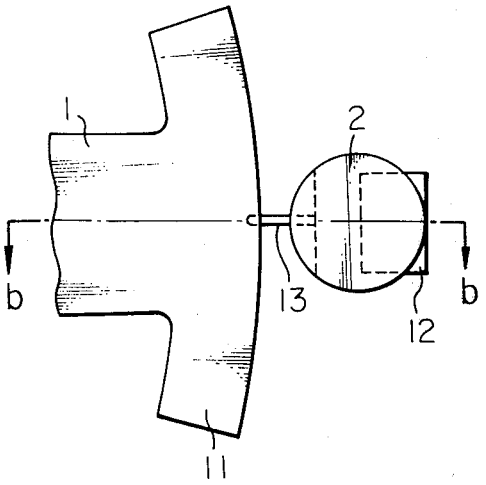
Fig. 10-c
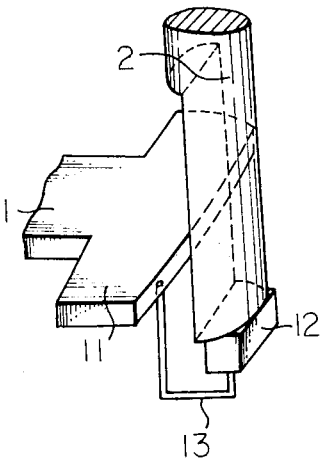
Fig. 10-b
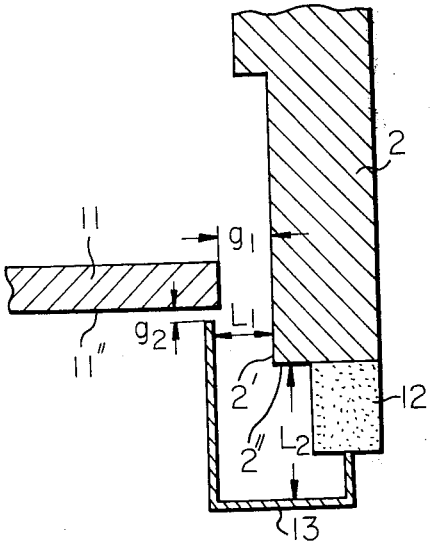

Fig. 11-a
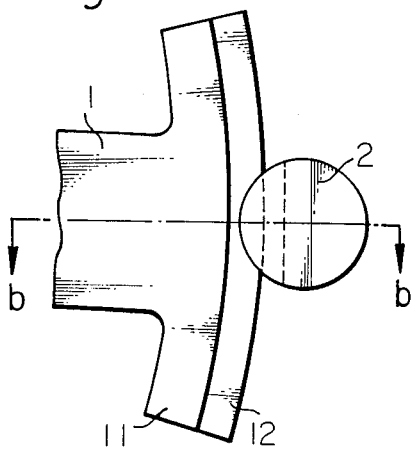
Fig. 11-c
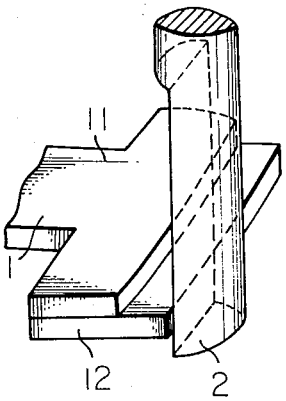
Fig. 11-b
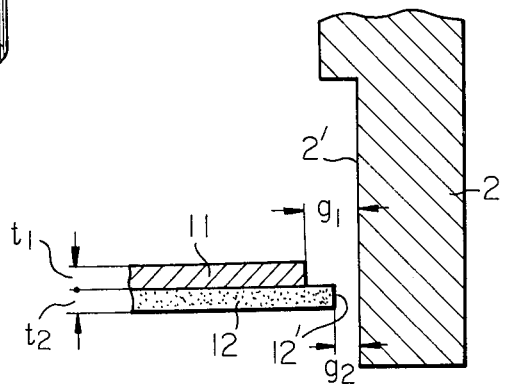

Fig. 12-a
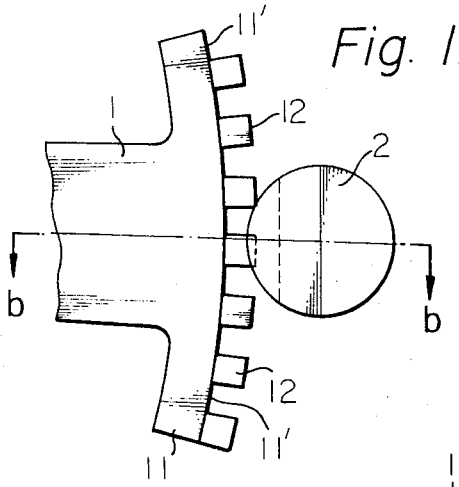
Fig. 13-a
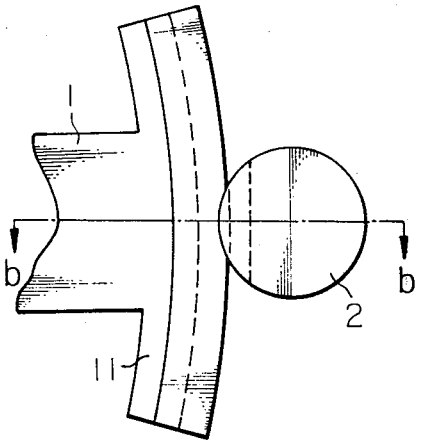
Fig. 12-b
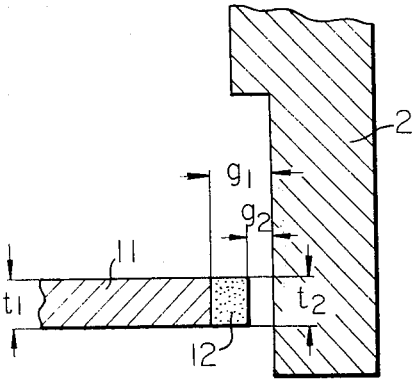
Fig. 13-b
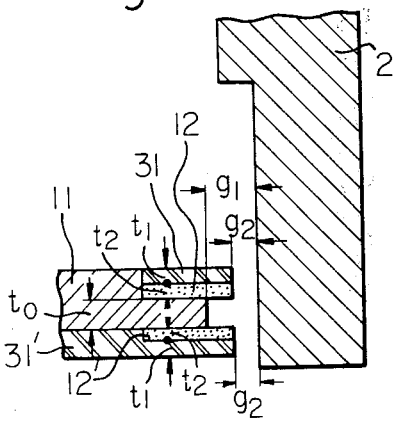

DISTRIBUTOR FOR AN INTERNAL COMBUSTION ENGINE CONTAINING AN APPARATUS FOR SUPPRESSING NOISE

The present invention relates generally to an apparatus for suppressing noise which radiates from the ignition system of an internal combustion engine, and more particularly relates to an apparatus for suppressing noise which generates from the electrodes of the distributor rotor and the stationary terminals, which are located in the distributor.

The igniter in which an electric current has to be intermitted quickly in order to generate a spark discharge, radiates the noise which accompanies the occurrence of the spark discharge. It is well known that the noise disturbs radio broadcasting service, television broadcasting service and other kinds of radio communication systems and as a result, the noise deteriorates the signal-to-noise ratio of each of the above-mentioned services and systems. Further, it should be recognized that the noise also may cause operational errors in electronic control circuits which will undoubtedly be more widely and commonly utilized in the near future as vehicle control systems, for example E.F.I. (electronic controlled fuel injection system), E.S.C. (electronic controlled skid control system) or E.A.T. (electronic controlled automatic transmission system), and as a result, traffic safety will be threatened. In addition, the tendency for an electric current flowing in the igniter to become very strong and to be intermitted very quickly to generate a strong spark discharge, will become a common occurrence because of the increasing emphasis on clean exhaust gas. However, strong spark discharge is accompanied by extremely strong noise which aggravates the previously mentioned disturbance and operational errors.

For the purpose of suppressing the noise, various kinds of apparatuses or devices have been proposed. However, most of the proposed apparatuses or devices are too expensive for practical use in mass-produced vehicles. Further, these apparatuses or devices are not, in practice, reliable. One prior art example which is considered to have practical value, is provided by the Japanese Patent Publication No. 48-12012. In this Japanese Patent, the spark gap between the electrodes of the distributor rotor and the stationary terminal in the distributor is selected to be between 1.524 (mm) and 6.35 (mm), which is wider than the spark gap used in the typical distributor.

In the prior art, there are three kinds of typical apparatuses for suppressing noise. A first typical one is the resistor which is S-, L- or K-shaped and is attached to the external terminal of the spark plug, wherein, in some cases, the resistor is contained in the spark plug and hence, is called a resistive spark plug. A second typical one is also a resistor which is inserted in one portion of the high tension cable and hence, is called a resistive high tension cable. A third typical one is the noise suppressing capacitor. However, the prior art apparatuses for suppressing noise, mentioned above, are defective in that although they can suppress noise to a certain intensity level, that level is not less than the noise level which must be suppressed in the fields of the above-mentioned broadcasting services, radio communication systems and electronic controlled vehicle control systems. Moreover, the noise suppressing capacitor has no effect on high-frequency noises.

Therefore, it is the principal object of the present invention to provide an apparatus for suppressing noise and to do so more effectively than that of the prior art.

Another object of the present invention is to provide a highly reliable apparatus for suppressing noise at a moderate price for use in vehicles which are mass-produced.

The present invention will be more apparent from the ensuing description with reference to the accompanying drawings wherein.

FIG. 3-*a* is a side view, partially cut off, showing a typical distributor;

FIG. 3-*b* is a sectional view taken along the line *b—b* of FIG. 3-*a;*

FIG. 4-*a* is a perspective view of a first embodiment according to the present invention;

FIG. 4-*b* is a plan view seen from the arrow *b* of FIG. 4-*a;*

FIG. 4-*c* is a sectional view taken along the line *c—c* of FIG. 4-*b;*

Figure 5:
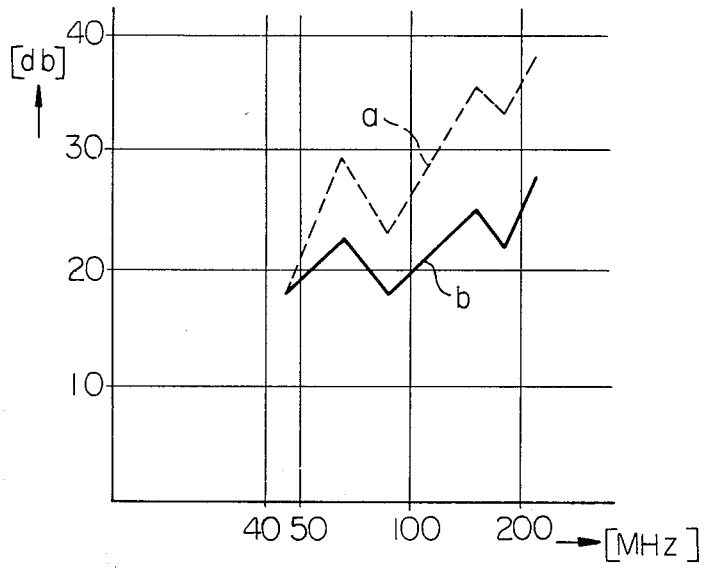
Figure 6:
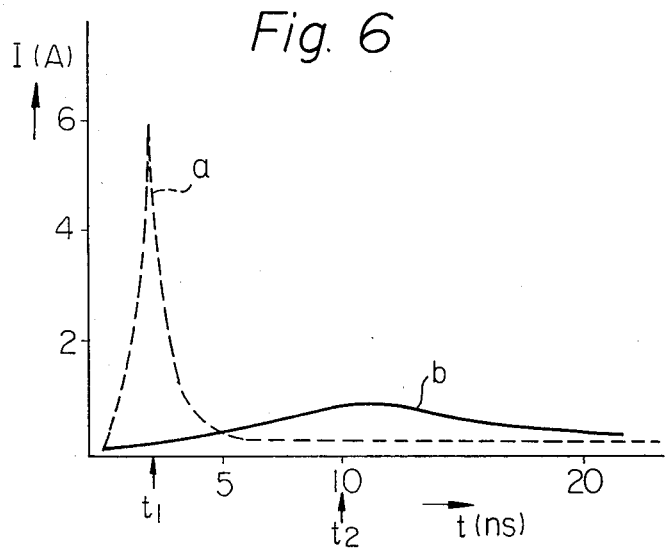

FIG. 5 is a graph showing changes of the noise-field intensity level (in db) which are produced by the igniters both of the prior art and the present invention with respect to an observed frequency (in MHz);

FIG. 6 is a graph showing changes of the current flow (in A), which is the so-called capacity discharge current, in the igniters both of the prior art and the present invention with respect to time (in ns);

FIG. 7-*a* is a plan view of a second embodiment according to the present invention;

FIG. 7-*b* is a sectional view taken along the line *b—b* of FIG. 7-*a;*

FIG. 8-*a* is a plan view of a third embodiment according to the present invention;

FIG. 8-*b* is a sectional view taken along the line *b—b* of FIG. 8-*a;*

FIG. 9-*a* is a plan view of a fourth embodiment according to the present invention;

FIG. 9-*b* is a sectional view taken along the line *b—b* of FIG. 9-*a;*

FIG. 9-*c* is a perspective view of the fourth embodiment;

FIG. 10-*a* is a plan view of a fifth embodiment according to the present invention;

FIG. 10-*b* is a sectional view taken along the line *b—b* of FIG. 10-*a;*

FIG. 10-*c* is a perspective view of the fifth embodiment;

FIG. 11-*a* is a plan view of a sixth embodiment according to the present invention;

FIG. 11-*b* is a sectional view taken along the line *b—b* of FIG. 11-*a;*

FIG. 11-*c* is a perspective view of the sixth embodiment;

FIG. 12-*a* is a plan view of a seventh embodiment according to the present invention;

FIG. 12-*b* is a sectional view taken along the line *b—b* of FIG. 12-*a;*

FIG. 13-*a* is a plan view of an eighth embodiment according to the present invention;

FIG. 13-*b* is a sectional view taken along the line *b—b* of FIG. 13-*a*

Figure 1:
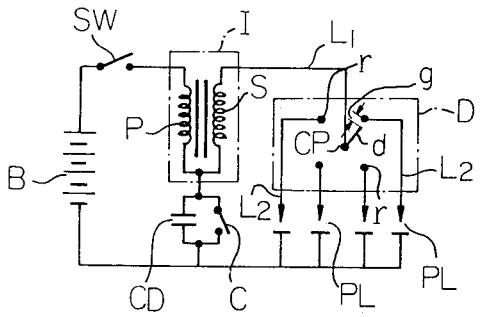
FIG. 1 is a typical conventional wiring circuit diagram of an igniter.

FIG. 1 is a typical conventional wiring circuit diagram of the igniter, the construction of which depends on the ignition system. In FIG. 1, a DC current which is supplied from the positive terminal of a battery B flows through an ignition switch SW, a primary winding P of an ignition coil I and a contact point C which has a parallelly connected capacitor CD, to the negative terminal of the battery B. When the distributor cam (not shown) rotates in synchronization with the rotation of the crank-shaft located in the internal combustion engine, the distributor cam cyclically opens and closes the contact point C. When the contact point C opens quickly, the primary current suddenly stops flowing through the primary winding P. At this moment, a high voltage is electromagnetically induced through a secondary winding S of the ignition coil I. The induced high-voltage surge, which is normally 10 – 30 (KV), leaves the secondary coil S and travels through a primary high tension cable $L_1$ to a center piece CP which is located in the center of the distributor D. The center piece CP is electrically connected to the distributor rotor *d* which rotates within the rotational period synchronized with said crank-shaft. Four stationary terminals *r*, assuming that the engine has four cyliners, in the distributor D are arranged with the same pitch along a circular locus which is defined by the rotating electrode of the rotor *d*, maintaining a small gap *g* between the electrode and the circular locus. The induced high-voltage surge is further fed to the stationary terminals *r* through said small gap *g* each time the electrode of the rotor *d* comes close to one of the four stationary terminals *r*. Then, the induced high-voltage surge leaves one of the terminals *r* and further travels through a secondary high tension cable $L_2$ to a corresponding spark plug PL, where a spark discharge occurs in the corresponding spark plug PL and ignites the fuel air mixture in the corresponding cylinder.

It is a well known phenomenon that noise is radiated with the occurrence of a spark discharge. As can be seen in FIG. 1, three kinds of spark discharge occur at three portions in the igniter, respectively. A first spark discharge occurs at the contact point C of the contact breaker. A second spark discharge occurs at the small *g* between the electrode of the rotor *d* and the electrode of the terminal *r*. A third spark discharge occurs at the spark plug PL.

In various kinds of experiments, the inventors discovered that, among the three kinds of spark discharge, although the first and third spark discharges can be suppressed ordinarily by the capacitor and resistive spark plug respectively the second spark discharge, which occurs at the small gap *g* between the electrode of the rotor *d* and the electrode of the terminal *r*, still radiates the strongest noise compared with the first and third spark discharge. This is because the second spark discharge includes a spark discharge, the pulse width of which is extremely small and the discharge current of which is extremely large. This spark discharge radiates the strongest noise from the high tension cables $L_1$ and $L_2$, which act as antennae.

Figure 2:
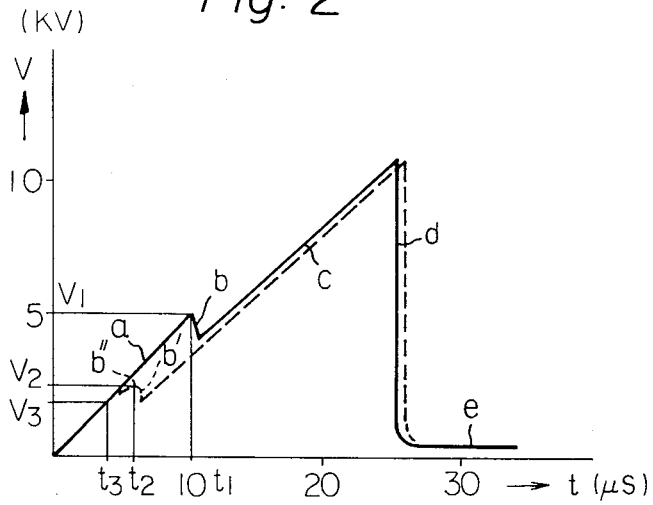
FIG. 2 shows a wave form of a voltage which occurs along a primary high tension cable $L_1$ and along a secondary high tension cable $L_2$.

The reason for the production of the spark discharge with an extremely small pulse width and an extremely large discharge current will be obvious from the following description and thereby, one will be able to proceed to the principles of the present invention. In FIG. 1, the high voltage of the induced high voltage surge from the secondary winding S appears at the rotor *d* not as a step-like wave but as a wave form like line *a* which is shown in FIG. 2. FIG. 2 shows a wave form which occurs along the primary high tension cable $L_1$ and the secondary high tension cable $L_2$, wherein the coordinates indicate voltage V (in KV) and time *t* (in $\mu$s). A voltage which appears at the rotor *d* increases along line *a* (FIG. 2) with a time constant the value of which is decided by the circuit constant of the ignition coil I, the capacitance of the capacitor CD which is connected parallel to the contact point C, the capacitance of the distributed capacity along the primary high tension cable $L_1$ and the distributed resistance of the primary high tension cable $L_1$. When the voltage which appears at the rotor *d* increases along line *a* and reaches the voltage $V_1$ which is a voltage sufficient to cause said second spark discharge, the voltage decreases along line *b* (FIG. 2) at the moment the second spark is discharged at the small gap *g* between the electrodes of the rotor *d* and the terminal *r*. This second spark discharge, indicated by line *b*, as mentioned previously, has an extremely small pulse width and an extremely large discharge current thereby radiating strong noise and considerable deleterious noise which is composed largely of high frequency components. When the second spark discharge occurs, the electric charge which has been charged to the distributed capacity along the primary high tension cable $L_1$ moves to a distributed capacity along the secondary high tension cable $L_2$ through the second spark discharge. And thus, the second spark discharge is called a capacity discharge. Voltage at the terminal of the spark plug PL increases immediately after the capacity discharge along line C shown in FIG. 2. The voltage indicated by line C increases with a time constant which is decided by the capacitance of distributed capacities along the primary high tension cable $L_1$ and the secondary high tension cable $L_2$, distributed resistance of the primary high tension cable $L_1$ and the secondary high tension cable $L_2$, a circuit constant of the ignition coil I and capacitance of the capacitor CD which is connected parallel to the contact point C. When the voltage increases in a wave form indicated by line C and reaches a voltage adequate to cause said third spark discharge at the spark plug PL, the voltage decreases suddenly along the line *d* shown in FIG. 2 and an inductive discharge which is indicated by line *e* in FIG. 2 follows immediately after the drop in voltage indicated by line *d*, whereby one ignition process is completed.

As mentioned above, the strongest noise which includes deleterious high frequency components is produced by said capacity discharge which is indicated by line *b* in FIG. 2. Therefore, the principles of the present invention are to transform the wave form indicated by line *b* into a wave form indicated by line *b'* and *b''* in FIG. 2, whereby the capacity discharge with an extremely small pulse width and an extremely large discharge current, changes to a capacity discharge with a relatively large pulse width and a relatively small discharge current. It should be noted that the intensity of noise which is produced by the transformed capacity discharge is considerably reduced and the deleterious high frequency components which are included in this noise are also considerably eliminated. The transformed capacity discharge, in other words, suppresses the maximum capacity discharge current which flows between the electrodes of the rotor *d* and the terminal *r* and at the same time, the transformed capacity discharge lengthens considerably the rise time of the capacity discharge current. With regard to the portions which are indicated by lines $b$, $b'$ and $b''$ in FIG. 2, it should be noted that the time which defines the portions $b$, $b'$ and $b''$ is partially extended so that it is longer than the actual time, to facilitate comprehension of the phenomenon.

The transformation of the wave form of the capacity discharge is realized, in the present invention, basically by the following construction. The distributor according to the present invention, includes a first discharging gap which exists between the electrodes of the rotor $d$ and the terminal $r$ and a second discharging gap which exists electrically parallel to and close to the first discharging gap, wherein one spark discharge at the second discharging gap occurs earlier than another spark discharge at the first discharging gap.

FIG. 3-$a$ is a side view, partially cut off, showing a typical conventional distributor. And FIG. 3-$b$ is a sectional view taken along the line $b$—$b$ of FIG. 3-$a$. In FIGS. 3-$a$ and 3-$b$, 1 indicates a distributor rotor (corresponding to $d$ in FIG. 1), 2 indicates a stationary terminal (corresponding to $r$ in FIG. 1) and the electrode of rotor 1 and the electrode of terminal 2 face each other with the small gap $g$ (FIG. 3-$a$) between them. A center piece 3 (corresponding to CP in FIG. 1) touches the center portion of the rotor 1. The induced high voltage surge at the secondary winding S (FIG. 1) travels through a primary high tension cable 4 (corresponding to $L_1$ in FIG. 1) and the center piece 3 to the electrode of the rotor 1. A spring 6 pushes the center piece 3 downward to the rotor 1, thereby making a tight electrical connection between them. At the time when the electrode of the rotor 1, which is indicated by the solid line in FIG. 3-$b$, faces the terminal 2, the high voltage surge is fed to the terminal 2 through a spark discharge and is applied to the corresponding spark plug PL (FIG. 1) through a secondary high tension cable 7 (corresponding to $L_2$ in FIG. 1), where the fuel air mixture is ignited in the corresponding cylinder. When the rotor 1 rotates to the position indicated by the dotted line in FIG. 3-$b$, and the electrode of the rotor 1 faces the next terminal 2, the high voltage surge is fed to the next terminal 2 through a spark discharge and is applied to the next corresponding spark plug PL (FIG. 1) through the other secondary high tension cable 7. In a similar way, the high voltage surge is sequentially distributed.

The present invention is applied to the elements which are surrounded by circle A indicated by the dotted line in FIG. 3-$a$. FIGS. 4 and 7 through 13 are enlarged views of the elements which are surrounded by circle A in FIG. 3-$a$. FIG. 4-$a$ is a perspective view showing the first embodiment according to the present invention. In FIG. 4-$a$ 11 indicates the electrode which is formed as a part of rotor 1 and is T-shaped. A front surface 11′ of the electrode 11 faces a side surface 2′ of the terminal 2 with a gap equivalent to the first spark discharging distance. Terminal 2 consists of a hollow or a solid circular shaft. The side surface of terminal 2 which faces the front surface 11′ is made by partially cutting off the circular shaft, and the side surface of the terminal acts as an electrode which cooperates with the electrode 11. A resistance element 12 which is rectangular and shaped like a long bar is connected to the base of the electrode 11 by, for example, a well-known electrically conductive adhesive. And further, metallic control electrode 13 is connected to the base of the resistance element 12 also by, for example, a well-known electrically conductive adhesive. The metallic control electrode 13, as shown, has a U-shaped section and has a plate-like flange which extends from one of the upper edges of said U-shaped portion. The other upper edge of said U-shaped portion 13′ faces the base of terminal 2 with a gap equivalent to the second discharging distance, and both the base and the edge 13′ act as electrodes. Fig. 4-$b$ is a plan view seen from the arrow $b$ of FIG. 4-$a$ and Fig. 4-$c$ is a sectional view taken along the line $c$—$c$ of FIG. 4-$b$. In FIG. 4-$c$, the front surface 11′ of electrode 11 faces the side surface 2′ of terminal 2 with the first spark discharging distance $g_1$ between them, thereby forming the first discharging gap. On the other hand, the base 2″ of terminal 2 faces the edge 13′ of the metallic control electrode 13 with the second spark discharging distance $g_2$ between them, thereby forming the second discharging gap. In this first embodiment, the first spark discharging gap $g_1$ and the second spark discharging gap $g_2$ are selected to be 1.4 (mm) and 0.2 (mm), respectively. The metallic control electrode is constructed from a brass plate which has a thickness of 0.6 (mm). Further, electrode 11 is constructed from a brass plate which has a thickness of 1.5 (mm), wherein the length L (FIG. 4-$b$) and the width W (FIG. 4-$b$) are selected to be 16 (mm) and 3 (mm), respectively. The resistance element 12 is made from carbon, the resistance of which is selected to be 1 ( MΩ ), measured by DC current provided between the top and base surfaces of the resistance element 12.

FIG. 5 is a graph clarifying the advantage of the present invention when compared to the prior art. In FIG. 5, the coordinates indicate noise-field intensity in db in which 0 [db] corresponds to 1 ($\mu$v/m), and the frequency in MHz at which the noise-field intensity is measured, wherein the performances of the present invention and the prior art are indicated by the solid line and the dotted line, respectively. The measurements indicated by the solid line and by the dotted line were obtained by using a vehicle to which the first embodiment, shown in FIGS. 4-$a$, 4-$b$ and 4-$c$, was applied and by using a vehicle in which the typical conventional resistive spark plug and resistive high tension cable were utilized. It is quite clear from FIG. 5 that the noise-field intensity produced by the igniter assuming present invention distributor is considerably minimized compared to that of the prior art igniter. Especially, the noise-field intensity of high frequencies is remarkably minimized by 10 [db] as compared to that of the prior art.

Now, referring again to FIGS. 4-$a$, 4-$b$ and 4-$c$, a possible reason for minimized noise-field intensity, according to the present invention, is offered by the following description. The high voltage surge from the secondary winding S of the ignition coil I is applied to the first discharging gap $g_1$ (FIG. 4-$c$) and the second discharging gap $g_2$ (FIG. 4-$c$) through the primary high tension cable 4 (FIG. 3-$a$). The voltage at the discharging gaps $g_1$ and $g_2$ increases in the form of a wave indicated by $a$ in FIG. 2. Since the second discharging gap $g_2$, which is 0.2 (mm), is shorter than the first discharging gap $g_1$, which is 1.4 (mm), a spark discharge at the second discharging gap $g_2$ occurs first at the time $t_3$ shown in FIG. 2, and consequently, the voltage which causes the spark discharge at gap $g_2$ at the time $t_3$ is relatively low, as shown by $V_3$ in FIG. 2. And voltage $V_3$ is much lower than voltage $V_1$ at which, as mentioned before, the capacity discharge occurs in the typical conventional distributor. This is because in the typical conventional system, the gap distance between the electrodes of rotor 1 and terminal 2 is 0.7 (mm), much longer than that of the second discharging gap $g_2$ of the present invention. When the spark discharge at gap $g_2$ occurs, the electric charge which has been charged to the distributed capacity along the primary high tension cable $L_1$ moves to the distributed capacity along the secondary high tension cable $L_2$. Thus, the capacity discharge current flows through the spark discharge at gap $g_2$. However, the capacity discharge current through gap $g_2$ is very small, because the above-mentioned capacity discharge current must flow through the metallic control electrode 13 and the resistance element 12, both shown in FIG. 4-*c*, thereby minimizing the capacity discharge current as it flows through resistance element 12. Thus, the maximum capacity discharging current which can occur in the prior art system is extremely limited. The voltage which appears at gap $g_2$ does not decrease, which is observed in the prior art as shown by line *b* in FIG. 2, but increases slowly as indicated by dotted line *b''* in FIG. 2. This is because the capacity discharge current, as mentioned previously, is very small that is there is less electron transfer and almost no voltage drop along the primary high tension cable 4 occurs.

When the voltage at gap $g_2$ and also, the first discharging gap $g_1$, increases slowly along the line *b''* (FIG. 2) and reaches the voltage $V_2$ at the time $t_2$, both shown in FIG. 2, another spark discharge occurs at the first discharging gap $g_1$. Actually, the spark discharge at gap $g_1$ occurs immediately after the occurrence of the spark discharge at gap $g_2$, although the distance of gap $g_1$ (=1.4 (mm) in the first embodiment) is much longer than that of gap $g_2$ (=0.2 (mm) in the first embodiment). The reason is considered to be as follows. When the spark discharge at gap $g_2$ occurs, air existing in the space near gap $g_2$ is ionized thus enabling the spark discharge to occur easily at gap $g_1$ located close to gap $g_2$. Spark discharge at gap $g_1$ is, in fact, triggered by the spark discharge at gap $g_2$. Thus, a disruptive discharge between the electrodes of the rotor 1 and the terminal 2 is completed very slowly along the dotted line *b''* and *b'* shown in FIG. 2. As can be seen in FIG. 2, the breakdown voltage $V_2$ is much lower than that of the prior art, the maximum capacity discharge current of the present invention is considerably minimized compared with that of the prior art, and furthermore, the rise time and pulse width of the capacity discharge current are considerably expanded when compared to those of the prior art, thereby minimizing the deleterious high frequency components which are included in the noise.

In FIG. 4-*c*, the first discharging gap $g_1$ and the second discharging gap $g_2$ must not only be connected electrically parallel to each other, but must also be located close to each other. The latter aspect will be self-evident from the above description with regard to the ionization of air. With regard to gaps $g_1$ and $g_2$, it should be recognized that if the electrodes forming gaps $g_1$ and $g_2$ are constructed with the same materials, the distance of the second discharging gap $g_2$ through which a first spark discharge occurs must be shorter than that of the first discharging gap $g_1$ through which a second spark discharge occurs after the said first spark discharge. However, if the electrode forming second discharging gap $g_2$ is formed by material selected to have a relatively lower disruptive voltage than the material of which the first discharging gap $g_1$ is defined, the difference between the gap distances of gap $g_1$ and gap $g_2$ poses no problem. The essential aspect is that one spark discharge should occur first through the second discharging gap $g_2$ to which the resistance element 12 is connected and a second spark discharge should follow the first spark discharge through the first discharging gap $g_1$.

In FIG. 2, after the first spark discharge at gap $g_2$ occurs at time $t_3$, the voltage between the electrodes of the rotor 1 and the terminal 2 increases slowly along the dotted line *b''* and when the voltage reaches the voltage $V_2$ at the time $t_2$, the second spark discharge occurs at gap $g_1$. At this time, the electric charge which has remained along the primary high tension cable $L_1$ without discharging to the secondary high tension cable $L_2$ through the first spark discharge at the time $t_3$, moves slowly to the secondary high tension cable $L_2$, where the capacity discharge current reaches its maximum value. At the same time, the voltage between the electrodes of rotor 1 and terminal 2 decreases slowly along the dotted line *b'*. After the disruptive discharge has occurred, the voltage changes further as indicated by the dotted line, the process of which is similar to the above-mentioned description with regard to line *c*, *d* and *e*, and finally, the spark plug PL ignites the fuel air mixture in the cylinder.

FIG. 6 is a graph showing the wave forms of the capacity discharge current, wherein the wave form indicated by the solid line *b* and the wave form indicated by the dotted line *a* show, respectively, the changes of the capacity discharge current according to the present invention and the prior art. In FIG. 6, the coordinates indicate a capacity discharge current I in A, and time in ns; however it should be noted that this time does not indicate actual time lapse of the phenomena but rather, indicates relative time, therefore FIG. 6 only shows the difference in the wave forms *a* and *b*. It is clear from FIG. 6, that the maximum capacity discharge current I, indicated by solid line *b*, according to the present invention, is reduced to about one-tenth of the maximum capacity discharge current I, indicated by dotted line *a*, according to the prior art. And further, the rise time and the pulse width of the capacity discharge current I, according to the present invention, are expanded to ten times the capacity discharge current I according to the prior art. Thus, according to the present invention, a capacity discharge current which includes deleterious high frequency components, consequently radiates strong noise, is transformed to a capacity discharge current which includes almost no deleterious high frequency components, resulting in maximum suppression of noise.

According to the present invention, the resistance value of the resistance element 12 is not limited to 1 [MΩ], but may be selected to be, for example, 100 [KΩ] or 10 [MΩ]. However, if the resistance value of the resistance element 12 is selected to be less than 100 [KΩ] or more than 10 [MΩ], full advantage for suppressing the noise intensity cannot be obtained. Further, the gap distances of the first discharging gap $g_1$ and the second discharging gap $g_2$ need not be limited to the values which were selected for the first embodiment. Moreover, neither the structure nor the arrangement of the metallic control electrode 13 and the resistance element 12 need be limited to the illustrations of FIGS. 4-*a*, 4-*b* and 4-*c*.

FIGS. 7 through 13 provide seven more embodiments, according to the present invention, wherein all the elements indicated in FIGS. 7 through 13 correspond to the elements referenced by the same numerals in FIGS. 4-*a*, 4-*b* and 4-*c*. FIG. 7-*a* is a plan view of the second embodiment and FIG. 7-*b* is a sectional view taken along the line *b*—*b* of FIG. 7-*a*. As can be seen in FIGS. 7-*a* and 7-*b*, the length L of the electrode 11 is 5 (mm) and is selected to be shorter than that of the first embodiment. Accordingly, the length of the resistance element 12 is shorter than that of the first embodiment. The resistance value of the resistance element 12 is selected to be 500 [KΩ] measured by the same method as for the embodiment of FIG. 4. The feature of the second embodiment is that metallic wire is used to form the metallic control electrode 13, as a result of which the following advantages can be obtained. The metallic control electrode 13 can be simply and cheaply manufactured and the gap distance $g_2$ can be easily adjusted. The other conditions, for example, the gap distances ($g_1$, $g_2$) and materials of which the metallic control electrode 13, the resistance element 12 and electrodes of rotor 1 and terminal 2 are made are the same as those of the first embodiment.

FIG. 8-*a* is a plan view of the third embodiment and FIG. 8-*b* is a sectional view taken along the line *b*—*b* of FIG. 8-*a*. As can be seen in FIGS. 8-*a* and 8-*b*, both the metallic control electrode 13 and the resistance element 12 have L-shaped sections. The metallic portion which is required to form a part of the second discharging gap $g_2$ is less than that of the first embodiment and the metallic control electrode 13 of the third embodiment can be manufactured more easily than that of the first embodiment. The feature of the third embodiment is that the resistance element 12 has an L-shaped section, thus providing the following advatage. The second discharging gap $g_2$, the gap distance of which is defined by the top surface 13′ of the metallic control electrode 13 and the base 2″ of the terminal 2, rigidly maintains a predetermined gap distance for a long period of time. This is because the L-shaped resistance element 12 which defines the gap distance $g_2$ in this embodiment is made of carbon, which has the well-known characteistic of resisting almost all variation in size or shape, regardless of the time factor. The other conditions, mentioned before, are the same as those in the first embodiment.

FIG. 9-*a* is a plan view of the fourth embodiment, FIG. 9-*b* is a sectional view taken along the line *b*—*b* of FIG. 9-*a* and FIG. 9-*c* is a perspective view of the fourth embodiment. In this embodiment, the resistance element 12 and the metallic control electrode 13 are both mounted on an insulator 21, wherein the insulator 21 is a ceramic plate and a resistor paste as resistance element 12 is applied to the ceramic plate by the screen printing process, which is usually utilized for manufacturing thick film integrated circuit. The metallic control electrode 13 is also attached to the ceramic plate 21. The ceramic plate, to which both the resistance element 12 and the metallic control electrode 13 are attached, is inserted in a trench formed in the electrode. The feature of the fourth embodiment is that the resistance element 12 and the metallic control electrode 13 form one body by attachment to the ceramic plate 21, providing the following advantages. The fourth embodiment is suitable for mass production and can be very cheaply manufactured. The other conditions, mentioned before, are the same as those of the first embodiment.

FIG. 10-*a* is a plan view of the fifth embodiment, FIG. 10-*b* is a sectional view taken along the line *b*—*b* of FIG. 10-*a* and FIG. 10-*c* is a perspective view of the fifth embodiment. As can be seen in FIGS. 10-*a*, 10-*b* and 10-*c*, the resistance element 12 and the metallic control electrode 13 are both arranged on part of the terminal 2. And further, the metallic control electrode 13 is made of metallic wire. In this particular embodiment: the diameter of the metallic control electrode 13 is 0.6 $\phi$; the resistance value of the resistance element 12 is 10 [MΩ], measured by DC current; gap distances of the first discharging gap $g_1$ and the second discharging gap $g_2$ are 0.7 (mm) and 0.2 (mm) respectively; the distance between the side surface 2′ of the terminal 2 and the top end of the metallic control electrode 13, indicated by $L_1$, and the distance between the base 2″ of the terminal 2 and the middle portion of the metallic control electrode 13, indicated by $L_2$, are 0.8 (mm) and 5.0 (mm) respectively. The feature of the fifth embodiment is that the resistance element 12 and the metallic control electrode 13, are both arranged on part of the terminal 2. The metallic control electrode 13 is made of metallic wire and is U-shaped. The following advantages may therefore be obtained. Both the resistance element 12 and the metallic control electrode 13 can work stably for a long period of time, because they are connected to terminal 2 which is stationary. Further, the gap distance of gap $g_2$ can easily be adjusted to a predetermined gap distance. The other conditions, mentioned before, are the same as those of the first embodiment.

FIG. 11-*a* is a plan view of the sixth embodiment, FIG. 11-*b* is a sectional view taken along the line *b*—*b* of FIG. 11-*a* and FIG. 11-*c* is a perspective view of the sixth embodiment.

In FIGS. 11-*a*, *b* and *c*, the metallic control electrode referenced by numeral 13, in the previous embodiments, is omitted and the side surface 12′ of the resistance element 12 directly and closely faces the side surface 2′, thereby forming the second discharging gap $g_2$. This embodiment is also effective for suppressing noise intensity. In the sixth embodiment: the thickness of the electrode 11 indicated by $t_1$ (FIG. 11-*b*) is 0.8 (mm); the thickness of the resistance element 12 made of carbon indicated by $t_2$ (FIG. 11-*b*) is 0.8 (mm); gap distances of gap $g_1$ and gap $g_2$ are 1.4 (mm) and 0.4 (mm) respectively. The feature of the sixth embodiment is the exclusion of the metallic control electrode, the function of which is performed by the side surface 12′ of the resistance element 12. Thus, the following advantages may be obtained. The efficiency of the second discharging gap $g_2$ is stably maintained for a long period of time, because gap $g_2$ is formed by only the resistance element 12. Accordingly, this embodiment can be manufactured at a very low cost. In this embodiment, the resistance element 12 should be made of a heat-proof resistor such as carbon, because spark discharge occurs directly on the surface of the resistance element 12. The other conditions, mentioned before, are the same as those of the first embodiment.

FIG. 12-*a* is a plan view of the seventh embodiment and FIG. 12-*b* is a sectional view taken along the line *b*—*b* of FIG. 12-*a*. The seventh embodiment is basically similar to the sixth embodiment, although the T-shaped resistance element 12 shown in FIG. 11-*a*, is divided into many sections. In the seventh embodiment: the thickness of the electrode 11 indicated by $t_1$ (FIG. 12-*b*) and the resistance element 12 indicated by $t_2$ are both 0.8 (mm); gap distances of gap $g_1$ and gap $g_2$ are 1.4 (mm) and 0.4 (mm) respectively; the resistance element 12 is comprised of seven carbon pieces, which are arranged along the side surface 11′ of the electrode 11. The features of the seventh embodiment are the exclusion of said metallic control electrode, similar to the sixth embodiment, and the plurality of resistance elements 12 are arranged along the side surface 11′, providing the following advantages. The efficiency of the second discharging gap $g_2$ may be stably maintained for a long period of time, because gap $g_2$ is formed by only the resistance element 12, without utilizing said metallic control electrode and accordingly, manufacturing cost is very low. Another advantage is that, even if at least one of the resistance elements 12 is broken by mishandling, the efficiency of the second discharging gap $g_2$ can still be maintained at a normal level by the other resistance elements 12 which are intact. It should be noted that the probability of all the resistance elements 12 being broken at the same time, is nil. The other conditions, as mentioned before, are the same as those of the first or sixth embodiment.

FIG. 13-*a* is a plan view of the eighth embodiment and FIG. 13-*b* is a sectional view taken along the line *b*—*b* of FIG. 13-*a*. As can be seen in FIGS. 13-*a* and *b*, part of the edge portion of the electrode 11 is sandwiched between the resistance elements 12 and 12′ (FIG. 13-*b*). Moreover, the resistance elements 12 and 12′ are sandwiched between insulators 31 and 31′. In the eighth embodiment: the thickness of the edge portion of the electrode 11 indicated by $t_o$ (FIG. 13-*b*) is 1 (mm); thickness of each insulator 31 and 31′, indicated by $t_1$ (FIG. 13-*b*), is 0.5 (mm); thickness of each resistance elements 12 and 12′ indicated by $t_2$ (FIG. 13-*b*), is 0.5 (mm), gap distances of gap $g_1$ and gap $g_2$ are 1.4 (mm) and 0.4 (mm) respectively; the insulators 31 and 31′ are both made of ceramic plates; the resistance elements 12 and 12′ are both made of carbon. The features of the eighth embodiment are the exclusion of said metallic control electrode, similar to the sixth and seventh embodiments, and the resistance element 12 (12′) which is covered by the ceramic plate 31 (31′), thus providing the same advantages as the sixth and seventh embodiments, as well as the advantage that the resistance element 12 (12′) is protected from external forces by the ceramic plate 31 (31′). An advantage with regard to the latter is that the resistance element 12 (12′) is protected by the ceramic plate 31 (31′) from external impact. Accordingly, the rotor of the present invention can be handled during the manufacturing process with almost the same precautions directed to the typical conventional rotor.

As mentioned above, the distributor according to the present invention extremely effective in suppressing noise intensity and further, it can be industrially realized. Moreover, it should be noted that the distributor according to the present invention can be applied to an internal combustion engine, together with the typical conventional apparatus for suppressing noise such as the resistive spark plug and/or the resistive high tension cable, since the typical conventional apparatus for suppressng noise is beneficial to the distributor of the present invention without the least interference.

What is claimed is:

1. An electrical interference suppressng distributor for a spark ignition internal combustion engine of the type that includes a housing, the housing having a central terminal for connection to a source of timed ignition pulses and a plurality of stationary terminals spaced on a circular locus concentric with the central terminal for connection to spark ignition devices of an engine, and a rotor located inside the housing for rotation about an axis through the central terminal, the rotor having a conductive member contacting the central terminal and includng a surface spaced from the circular locus to define a first discharge gap between said surface and each terminal, wherein the improvement comprises:

an electrode member that includes a portion located close to the first discharge gap to define a second discharge gap having a distruptive voltage lower than that of the first discharge gap, the electrode member further including a resistance element connected in series with the second discharge gap between each stationary terminal and the conductive member, the path through the resistance element and second discharge gap being electrically in parallel with the path through the first discharge gap, such that an ignition pulse applied to the central terminal when the rotor is aligned with a stationary terminal will cause a spark discharge between the rotor and the stationary terminal to occur initially as a low current discharge through the second discharge gap followed immediately by a main current discharge through the adjacent first discharge gap.

2. An electrical interference suppressing distributor as in claim 1 wherein the resistance element is made of carbon.

3. An electrical interference suppressing distributor as in claim 1 wherein the surface of the conductive member defining the first gap comprises an outer peripheral surface; each stationary terminal comprises a side surface lying on the circular locus and an end surface lying in the plane of the circular locus, the first discharge gap being defined between the outer peripheral surface of the conductive member and the side surface of each stationary terminal; and the electrode member comprises a metal channel having a U-shaped cross section, the second discharge gap being defined between one edge of the U-shaped channel and the end surface of each stationary terminal, and the resistance element being connected between the other edge of the channel and the conductive member.

4. An electrical interference suppressing distributor as in claim 1 wherein the surface of the conductive member defining the first gap comprises an outer peripheral surface; each stationary terminal comprises a side surface lying on the circular locus and an end surface lying in the plane of the circular locus, the first discharge gap being defined between the outer peripheral surface of the conductive member and the side surface of each stationary terminal; and the electrode member comprises a metal wire bent into a U, the second discharge gap being defined between one end of the U-shaped wire and the end surface of each stationary terminal, and the resistance element being connected between the other end of the wire and the conductive member.

5. An electrical interference suppressing distributor as in claim 1 wherein the surface of the conductive member defining the first discharge gap comprises an outer peripheral surface; each stationary terminal comprises a side surface lying on the circular locus and an end surface lying in the plane of the circular locus, the first discharge gap being defined between the outer peripheral surface of the conductive member and the side surface of each stationary terminal; the electrode member comprises a metallic plate having an L-shaped cross section, the second discharge gap being defined between a side surface of one leg of said L-shaped metallic plate and the end surface of each stationary terminal; and the resistance element comprises an angle member having an L-shaped cross section, one surface of said resistance element beng attached to a side surface of the other leg of the L-shaped metallic plate and another surface of the resistance element being attached to the conductive member.

6. An electrical interference suppressing distributor as in claim 1 wherein the surface of the conductive member defining the first discharge gap comprises an outer peripheral surface; each stationary terminal comprises a side surface lying on the circular locus and an end surface lying in the plane of the circular locus, the first discharge gap beng defined between the outer peripheral surface of the conductive member and the side surface of each stationary terminal; the rotor includes a groove in one surface; the electrode member comprises an insulator inserted in the groove and a metallic plate mounted on the insulator, the second gap being defined between a portion of the metallic plate and the end surface of each stationary terminal; and the resistance element is mounted on the insulator with one portion in contact with the metallic plate and another portion inserted into the groove in contact with the conductive member.

7. An electrical interference suppressng distributor as in claim 6 wherein the insulator comprises a ceramic plate, and the resistance element is made of a resistor paste.

8. An electrical interference suppressing distributor as in claim 1 wherein the surface of the conductive member defining the first discharge gap comprises an outer peripheral surface, each stationary terminal comprises a side surface lying on the circular locus and an end surface lying in the plane of the circular locus, the first discharge gap beng defined between the outer peripheral surface of the conductive member and the side surface of each stationary terminal; the electrode member comprises a U-shaped metallic wire, the second discharge gap being defined between one end of said U-shaped wire and a surface of the conductive member that is parallel to the plane of the circular locus; and the resistance element is connected between the other end of the U-shaped wire and the end surface of each stationary terminal.

9. An electrical interference suppressing distributor as in claim 1 wherein the surface of the conductive member defining the first discharge gap comprises an outer peripheral surface, each stationary terminal comprises a side surface lying on the circular locus, the first discharge gap being defined between the outer peripheral surface of the conductive member and the side surface of each stationary terminal; and the electrode member comprises the resistance element, said element being attached to a surface of the conductive member that is parallel to the plane of the circular locus and having an outer peripheral surface facing the side surface of each stationary terminal, the second discharge gap being defined between the outer peripheral surface of the resistance element and the side surface of the stationary terminal.

10. An electrical interference suppressing distributor as in claim 1 wherein the surface of the conductive member defining the first discharge gap comprises an outer peripheral surface; each stationary terminal comprises a side surface lying on the circular locus; and the electrode member comprises a plurality of annular segments of said resistance elements attached in circumferentially spaced relation to the outer peripheral surface of the conductive member, the second discharge gap being defined between the side surface of the stationary terminal and the facing peripheral surfaces of the resistance element segments, and the first discharge gap beng defined between the side surface of the stationary terminal and the portions of the outer peripheral surface of the conductive member exposed between the resistance element segments.

11. An electrical interference suppressng distributor as in claim 1 wherein the surface of the conductive member defining the first discharge gap comprises an outer peripheral surface; each stationary terminal comprises a side surface lying on the circular locus; and the electrode member comprises a pair of laminations of the resistance element attached to spaced surfaces of the conductive member parallel to the plane of the circular locus and bounding the outer peripheral surface of the conductive member, each lamination of the resistance element having an outer peripheral surface, the first discharge gap being defined between the outer peripheral surface of the conductive member and the side surface of each stationary electrode, and the second discharge gap being defined between the outer peripheral surface of each lamination and the side surface of each stationary electrode.

12. An electrical interference suppressing distributor as in claim 11 further comprising a pair of insulators attached to the laminations of the resistance element to sandwich the resistance element laminations between the insulators and the conductive member.

13. An electrical interference suppressing distributor as in claim 12 wherein the insulators comprise ceramic plates.

* * * * *